United States Patent [19]

Sejimo

[11] Patent Number: 4,770,822

[45] Date of Patent: Sep. 13, 1988

[54] DIAPHRAGM CARBURETOR FOR INTERNAL COMBUSTION ENGINE

[75] Inventor: Yoshimi Sejimo, Urayasu, Japan

[73] Assignee: Walbro Far East, Inc., Kawasaki, Japan

[21] Appl. No.: 84,858

[22] Filed: Aug. 13, 1987

[30] Foreign Application Priority Data

Oct. 9, 1986 [JP] Japan ..... 61-155542[U]

[51] Int. Cl.[4] ..... F02M 17/04

[52] U.S. Cl. ..... 261/35; 261/95; 261/97; 261/DIG. 68; 261/DIG. 81

[58] Field of Search ..... 261/35, DIG. 81, DIG. 68, 261/95, 97

[56] References Cited

U.S. PATENT DOCUMENTS

| | | | |
|---|---|---|---|
| 3,177,920 | 4/1965 | Phillips | 261/DIG. 68 |
| 3,235,238 | 2/1966 | Martin et al. | 261/DIG. 68 |
| 3,738,622 | 6/1973 | Tuckey | 261/DIG. 68 |
| 4,271,093 | 6/1981 | Kobayashi | 261/DIG. 68 |
| 4,335,061 | 6/1982 | Kobayashi | 261/DIG. 68 |
| 4,597,915 | 7/1986 | Nagase et al. | 261/DIG. 81 |

FOREIGN PATENT DOCUMENTS

| | | | |
|---|---|---|---|
| 59-103948 | 6/1984 | Japan | 261/DIG. 81 |
| 61-132761 | 6/1986 | Japan | 261/DIG. 81 |

*Primary Examiner*—Tim Miles

*Attorney, Agent, or Firm*—Barnes, Kisselle, Raisch, Choate, Whittemore & Hulbert

[57] ABSTRACT

A diaphragm carburetor with a fuel metering chamber designed for easy restart when hot which includes a separate escape chamber connected to the metering chamber having a second diaphragm controlled exhaust valve. The second diaphragm is subject to positive crankcase pressure during engine operation to maintain the exhaust valve closed. When the engine is stopped, the exhaust valve is opened by a spring and fuel in the metering chamber will move into the escape chamber and out of the carburetor rather than be forced into the fuel mixing passage and venturi of the carburetor. A porous absorbent material is positioned to receive the fuel leaving the open exhaust valve and to retain it until it vaporizes and dissipates through openings in the retainer atmosphere. The exhaust valve may be manually operated as an option.

5 Claims, 3 Drawing Sheets

DIAPHRAGM CARBURETOR FOR INTERNAL COMBUSTION ENGINE

FIELD OF INVENTION

The present invention particularly relates to a diaphragm carburetor for an internal combustion engine which is excellent for hot restartability.

BACKGROUND AND OBJECTS OF THE INVENTION

Generally, hot restartability of a small internal combustion engine provided with a diaphragm carburetor is not good for several reasons mentioned below:

(a) A metering chamber is heated by heat of the engine, atmosphere heat, radiant heat of sunshine and the like after the engine has been stopped. This occurs particularly after operation with high load under a burning sun in a summer season. If the metering chamber is heated as described above, fuel having a low boiling point interiorly stored is changed into vapor and flows from a fuel passage to the air inlet and a venturi portion of a carburetor. At the same time, liquid fuel must also flow out and vapor and liquid in the air inlet and venturi may flow into an engine crankcase depending on the attitude of the engine.

(b) Particularly, in the period 15 to 20 minutes or so after the engine has been stopped, the fuel in the metering chamber discharges completely into the air inlet, and the interior of the fuel chamber is filled with fuel vapor.

(c) When the recoil starter is pulled to restart the engine, fuel in the form of liquid and vapor in the air inlet and venturi portion is taken into the engine all at once and supplied in the form of a super-rich mixture. Therefore, the engine will not start.

Particularly, at the time of restarting the engine in 15 to 20 minutes after the engine has been stopped, the engine is still in a hot state requiring no rich-mixture, and therefore, when the super-rich mixture is supplied, the engine is more difficult to start.

(d) In such a state as described above, roping, that is, pulling the recoil starter rope, is carried out several times to discharge the super-rich mixture, and the initial explosion can be effected only when the interior of the cylinder has a mixture in the range of combustion.

(e) When a throttle valve is opened and roping is effected at a start position, a mixture may be exhausted with less roping to effect the initial explosion. However, since the throttle valve is opened, venturi pressure is so low as not to be able to draw vapor from the metering chamber, and even if the initial explosion is effected, the engine will not continue running but soon stops. Even if roping is effected over and over again thereafter, the engine will not start.

(f) In the case where the throttle valve is in the idling position, roping has to be done over and over again to exhaust the rich mixture. An ignition plug may become covered with the mixture depending on the attitude of the engine and the position of the ignition plug, and this also will contribute to the failure to restart.

(g) The outflow of fuel in the air inlet and venturi portion from the metering chamber after the engine has been stopped makes it difficult to provide hot restart regardless of whether the throttle valve portion is opened or in the idling position.

(h) When the choke valve is used in the state wherein the engine is hot, fuel accumulated in the air inlet is supplied in its richer state to the engine, and again the engine is difficult to restart.

As means for solving these problems noted above, the present applicant has proposed an improved diaphragm carburetor as described in U.S. patent application, Ser. No. 36,442, filed Apr. 9, 1987, and patent application Ser. No. 84,894, filed Aug. 13, 1987. According to the diaphragm carburetors disclosed in said patent applications, fuel is discharged from the metering chamber through an exhaust valve and directly discharged onto the ground, and sometimes splashed on the clothes of an operator, which presents the danger of fire and other inconvenience.

Furthermore, in the case of the chain saw, a carburetor is often mounted inside of a case containing the carburetor and air required for combustion is introduced into the carburetor through this case. Therefore, fuel discharged from the metering chamber is discharged into the case, and since the case is extremely hot, fuel immediately vaporizes to fill the interior of the case. Thus, a super-rich mixture is supplied when the engine is to be restarted making it difficult to smoothly start the engine.

In order to overcome the aforementioned problem, the present invention provides a diaphragm carburetor for the internal combustion engine wherein a metering chamber of a diaphragm carburetor is closed during operation of the engine while being opened to atmosphere when the engine is not running and fuel discharged from the metering chamber is temporarily stored in a liquid intake member.

For achieving the above-described object, the present invention provides an arrangement wherein a liquid absorbing intake member is connected externally of an atmospheric port of an exhaust valve for closing a metering chamber of the diaphragm carburetor during operation of the engine while opening said chamber to atmosphere when the engine is not running.

BRIEF DESCRIPTION OF THE DRAWINGS

DRAWINGS accompany the disclosure and the various views thereof may be briefly described as.

DETAILED DESCRIPTION OF THE INVENTION AND THE OPERATION

Figure 1:
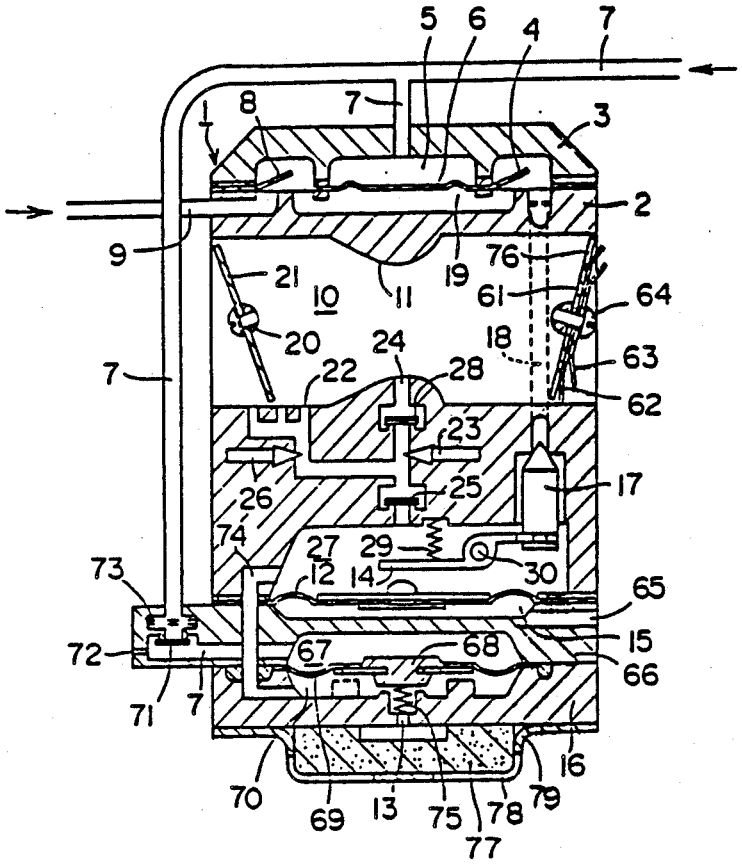
FIG. 1, a side sectional view of a diaphragm carburetor for the internal combustion engine according to a first embodiment of the present invention.

Since a diaphragm valve 68 causes an atmospheric port 13 to be closed by positive pressure of a crank chamber during operation of the engine, a metering chamber 27 is not at all affected, and the engine operates normally. When the engine is stopped, the positive pressure acting on the diaphragm 68 ceases to exist and therefore the diaphragm valve 68 moves under the force of a spring 75 to open the atmospheric port 13. Accordingly, even if fuel in the metering chamber 27 is expanded by the engine or ambient heat, the fuel is not injected into venturi portion 11 of the carburetor but is exhausted from the atmospheric port 13 to a liquid absorbing intake member 77 through the diaphragm valve 68. The fuel is temporarily stored in the liquid intake member 77 and gradually vaporized and dissipated into the atmosphere. Accordingly, an engine-start-difficulty is overcome without having super-rich fuel in the venturi at the time of restaring the engine.

In restarting the engine, a choke valve 61 is fully closed, and the metering chamber 27 is filled with fuel by a single roping, after which the choke valve is opened to allow further roping. then restarting may be accomplished easily and thereafter operation of the engine may be continued smoothly.

As the exhaust valve, a check valve 60 (FIG. 2), a hand-operated tapered cock 37 (FIG. 3), or a needle valve 41 (FIG. 4) actuated by intake negative pressure, may be used in place of the diaphragm valve 68.

As shown in FIG. 1, a cover 3 is connected with a diaphragm 6 interposed, to the upper wall of a carburetor body 2 provided with venturi 11 in an intake passage 10 and a connection body 66 is connected, with a diaphragm 12 interposed, to the lower wall thereof.

A pulsating pressure inlet 7 provided in the cover 3 is connected to a crank chamber of a two-cycle engine (not shown), and the pulsating pressure acts on the diaphragm 6 of a pulsating pressure inlet chamber 5 constituting a fuel pump. A fuel chamber 19 defined by the diaphragm 6 is connected to an inlet 9 through a check valve 8 and is connected to a metering chamber 27 through a check valve 4, passage 18 and an inlet valve 17.

An atmospheric chamber 15 between a diaphragm 12 defining the metering chamber 27 and the connection body 66 is opened into atmosphere through an atmospheric port 65. An inlet valve 17 in the form of a needle valve is disposed at the end of a passage 18 and is opened and closed by means of a lever 14. That is, one end of the lever 14, pivotally supported on the wall of the metering chamber 27 by means of a shaft 30, is biased into engagement with the end of the inlet valve 17 by the pressure of a spring 29. The other end of the lever 14 abuts on a projection connected generally in the center of the diaphragm 12. The metering chamber 27 is connected to a high speed fuel jet 24 of the intake passage 10 and is connected to a low speed fuel jet 22 through a low speed fuel metering valve 26. Check valves 25 and 28 are provided in the fuel passages leading to the high speed jet 24 and the low speed fuel jet 22. It is noted that the above-described construction is similar to that of a carburetor proposed in a copending application, Ser. No. 36,442, filed Apr. 9, 1987, and assigned to a common assignee.

According to the present invention, the pulsating pressure inlet chamber 67 is separated from the escape chamber 70 by the diaphragm 69 sandwiched between the connection body 66 and the cover 16, and the escape chamber 70 is connected to the metering chamber 27 via a passage 74 and is brought into communication with the atmospheric port 13 through the diaphragm valve 68.

A liquid intake member 77, formed of a porous material such as sponge or sintered metal having gasoline resisting properties, externally of the atmospheric port 13 is secured to the undersurface of the cover 16 by means of a keeper plate 79 having an opening 78.

A spring 75 is interposed between the cover 16 and the diaphragm valve 68. The pulsating pressure inlet chamber 67 is in communication with atmosphere through a passage 7 and leak hole 72 and connected to the crank chamber of the engine through a check valve 71, a screen 73 and the passage 7.

A throttle valve 21 supported on a valve shaft 20 is disposed in an intake passage 10. Upstream of the intake passage 10, more specifically, upstream away from the venturi portion 11, a choke valve 61 supported on a valve shaft 64 is formed with notches 76 in the form of leak holes at both upper and lower ends of a disk. A valve plate 62 formed of a temperature responsive alloy and a back-up plate 63 are superposed on the choke valve 61. In the event the atmospheric temperature is low, the edges of the valve plate 62 formed of the temperature responsive shape storage alloy are closely superposed on the choke valve 61 so as to close the notches 76. The notches 76 are opened and closed by the valve plate 62 according to the atmospheric temperature to adjust the choking effect of the choke valve 61. Thus, the quantity of fuel taken into the intake passage 10 from the low speed fuel jet 22 is adjusted by the intake negative pressure passing the throttle valve 21, whereby a mixture having a concentration approximately suitable for the temperature of the engine is supplied to the engine. However, an ordinary choke valve may be installed.

Next, the operation of the diaphragm carburetor for the internal combustion engine according to the present invention will be described.

In a manner similar to a conventional diaphragm carburetor of the same kind, fuel in a fuel tank (not shown) is supplied, by the diaphragm operated by the pulsating pressure of the crank chamber of the engine, to the metering chamber 27 through the check valve 8, fuel chamber 19, check valve 4, passage 18, inlet valve 17 and the like. However, fuel pressure in the chamber 27 is maintained by a predetermined level by the spring 29 acting on the lever 14 pivotally moved about the shaft 30 and the diaphragm 12 subjected to atmospheric pressure. The fuel is injected into the intake passage 10 and supplied to the engine through the low speed fuel metering needle valve 26 or high speed fuel metering needle valve 23 depending on the position of the throttle valve 12.

During operation of the engine, the screen 73 and the check valve 71 are forced opened and only the positive pressure of the crank chamber is introduced from the pulsating pressure inlet pipe 7 into the pulsating pressure inlet chamber 67. The diaphragm valve 68 supported on the diaphragm 69 causes the atmospheric port 13 to be closed against the force of the spring 75.

After the engine has been stopped, the diaphragm carburetor 1 is heated, and fuel in the metering chamber 27 is expanded and flows into the escape chamber 70 via the passage 74. On the other hand, as the engine stops, pressure of the pulsating pressure inlet chamber 67 is gradually reduced to atmospheric pressure via the leak hole 72, and therefore the diaphragm 69 is raised under the action of the force of the spring 75 so that the escape chamber 70 comes into communication with the atmospheric port 13. In this way, fuel in the metering chamber is not injected into the intake passage 10 due to the thermal expansion but is discharged into the liquid absorbing intake member 77 through the passage 74, the escape chamber 70 and the atmospheric port 13. The fuel temporarily remains therein and gradually vaporizes and escapes into the atmosphere.

According to the present invention, even if the engine is stopped, the heated fuel vapor in the metering chamber is automatically discharged into the liquid intake member 77 located outside. Therefore, the subsequent restarting of the engine may be accomplished extremely easily even by an unskilled person who is not aware of the characteristics of the diaphragm carburetor of this kind.

In restarting the engine, the choke valve 61 is fully closed and the metering chamber 27 is filled with fuel by a single pull on the recoil starter rope, after which the choke valve 61 is opened preparatory to further roping. Then, in this case, since the metering chamber 27 is filled with fuel, restarting may be easily accomplished, and thereafter operation of the engine may be continued smoothly.

In the case of the choke valve 61 provided with the valve plate 62 formed of a temperature responsive alloy as in the illustrated embodiment, the leak hole 76 remains opened even if the choke valve 61 is fully closed, and therefore the restarting may be readily achieved by roping.

Figure 2:
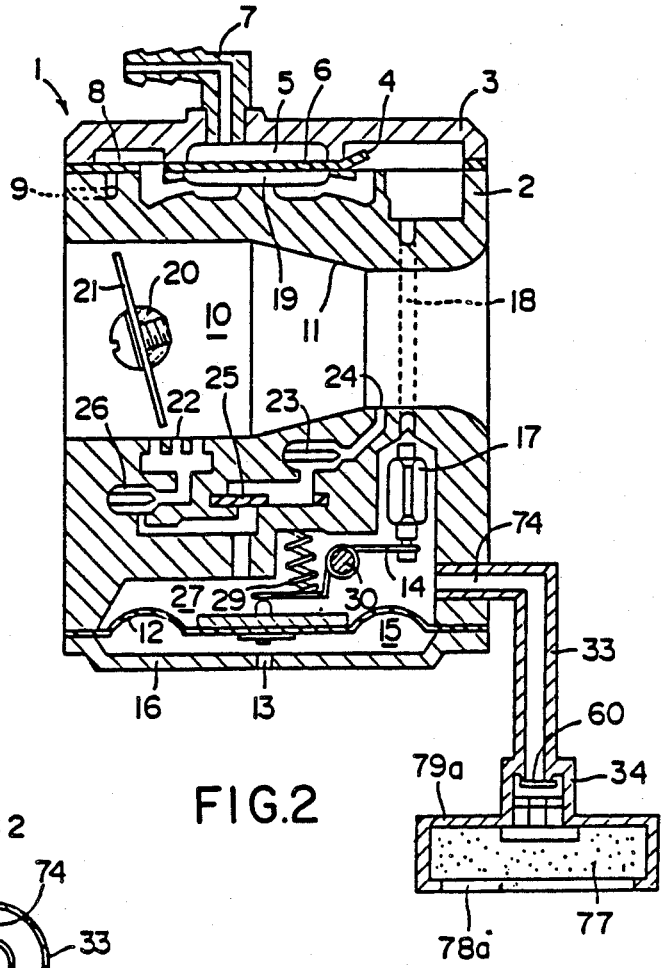
FIG. 2, a side sectional view of the diaphragm carburetor according to a second embodiment of the present invention.

In the embodiment shown in FIG. 2, a check valve 60 in the form of an exhaust valve is connected to an output passage 74 of a metering chamber 27 through a pipe 33, and a liquid intake member 77 is provided downstream thereof in a box 79*a* having an opening 78*a*. In this embodiment, when the fuel vapor pressure in the metering chamber 27 abnormally rises after the engine has been stopped, the check valve 60 is opened so that the heated fuel in the metering chamber 27 is taken into the liquid intake member 77 and subsequently evaporated to atmosphere.

Figure 3:
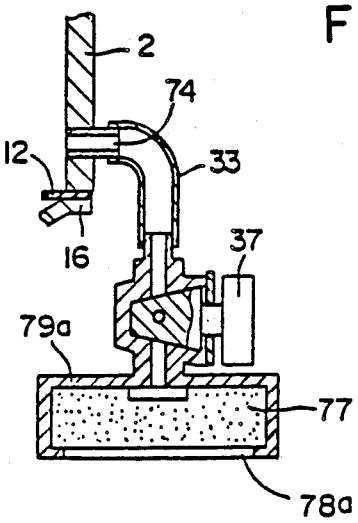
FIG. 3, a side sectional view showing essential parts of the diaphragm carburetor according to a third embodiment of the present invention.

In the embodiment shown in FIG. 3, a hand-operated tapered cock 37 as an exhaust valve is provided in place of the check valve 60, and the other structures are similar to those of the embodiment shown in FIG. 2. Thus, after the engine has been stopped, the tapered cock 37 may be rotated to bring the pipe 33 into communication with the interior of the box 79*a*, the heated fuel vapor in the metering chamber 7 can be received in the member 77 and discharged as vapor out of the opening 78*a*.

Figure 4:
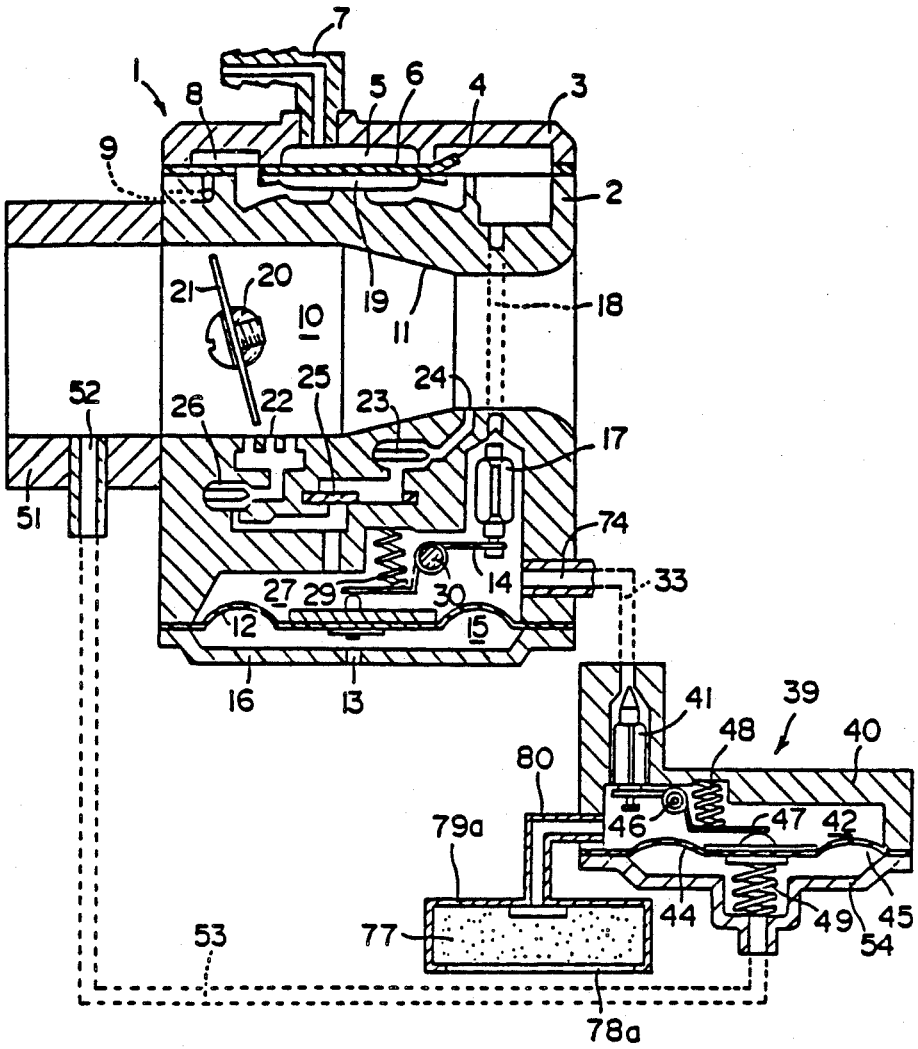
FIG. 4, a side sectional view of the diaphragm carburetor according to a fourth embodiment of the present invention.

In the embodiment shown in FIG. 4, the metering chamber 27 is brought into communication with a chamber 42 of a housing 40 via a needle valve type inlet valve 41 of an exhaust device 39 connected to the outlet passage 74 by means of the pipe 33, said chamber 42 being brought into the liquid intake member 77 via a pipe 80, the liquid intake member 77 being accommodated in a box 79*a* having an opening 78*a*. The chamber 42 is defined by a diaphragm 44 sandwiched between the housing 40 and the cover 54. A chamber 45 is brought into communication with a negative pressure intake 52 of an intake connection pipe 51 through a pipe 53. One end of a lever 47 pivotally disposed at pivot 46 within the chamber 42 receives the force of a spring 48 to raise the inlet valve 41 and close the pipe 33, at which time a diaphragm 44 in abutment with the other end of the lever 47 is pulled downwardly by intake negative pressure introduced into the chamber 45 against the force of the spring 49 through passage 53.

According to the above-described embodimennt, when the engine is stopped, the chamber 45 is exposed to atmospheric pressure. Therefore, the diaphragm 44 is raised by the force of the spring 49, and the lever 47 is turned counterclockwise against the force of the spring 48 to open the inlet valve 41. Accordingly, the fuel vapor in the metering chamber 27 flows into the chamber 42 via the outlet passage 74 and the pipe 33 and is received into the liquid intake member 77 through a pipe 80.

The present invention may be applied also to a diaphragm carburetor provided with a primer pump or the like which forceably supplies fuel to the metering chamber at the time of starting the engine.

According to the present invention, as described above, fuel can be supplied in a manner similar to a conventional diaphragm carburetor to the internal cumbustion engine, and in addition the following effects may be obtained:

(a) Since the exhaust valve is provided in the metering chamber of the diaphragm carburetor to close the metering chamber during operation of the engine and to open the chamber to atmosphere when the engine is not operating, fuel in the metering chamber is not expanded and discharged into the carburetor intake passage after the engine has been stopped, and the hot restartability of the engine is not impaired.

(b) Since fuel in the metering chamber is discharged into the liquid intake member 77 after the engine has been stopped and fuel in the metering chamber is not forced into the intake passage, the choke valve is closed, at the time of hot restarting, and a single roping is effected whereby the metering chamber can be filled with fuel. Subsequently, when the choke valve is opened and roping is effected, the engine may be restarted easily.

(c) In the arrangement wherein positive pressure from the crank chamber is made to act on the diaphragm, during operation of the engine, to close the exhaust valve, a substantial pressure is exerted by the diaphragm to hold the exhaust valve closed, and this valve is only opened by the spring when the engine is not running. In other words, the construction is simple, and the present invention may be readily applied to existing diaphragm carburetors.

(d) As described above, since the pressure closing the diaphragm is great, even if the diaphragm carburetor is used on an internal combustion engine, for example, for operating a chain saw which is subjected to great vibration and generates a large quantity of dust, a stabilized operation without trouble may be maintained.

(e) Since fuel discharged outward from the metering chamber is temporarily retained in the liquid intake member and gradually vaporized into atmosphere, the fuel is not discharged directly onto the ground where dead grass may be present nor splashed on the clothes of an operator and thus fire hazard is avoided.

Even if a working machine is inclined when an engine is not operating, no spillage occurs since fuel in the metering chamber or escape chamber is absorbed and retained in the liquid intake member.

(f) Particularly in the case where the present invention is used for a carburetor for the engine of a portable machine such as a chain saw, the carburetor is often confined in a case, and air required for combustion passes through the case and is introduced into the carburetor. And, if fuel in the metering chamber is discharged outward, some portion will remain in the case and when vaporized will fill the case with vapor. Under such conditions as described, fuel vapor within the case is carried along with suction gas into the carburetor when the engine is restarted to form a super-rich mixture, thus impairing the smooth start of the engine. However, according to the present invention, as described above, the discharged fuel does not fill the case but is taken into the liquid intake member and gradually scattered into atmosphere, thus overcoming the aforementioned inconveniences.

What is claimed is:

1. A diaphragm carburetor for an internal combustion engine comprising diaphragm means forming a fuel metering chamber, passage means between said chamber and the atmosphere, exhaust valve means for closing said passage means during operation of the engine and for opening said passage means when the engine is inoperative to purge said chamber, and a fuel absorbing element located at the outlet of said passage means to receive and dissipate purged fuel.

2. The diaphragm carburetor according to claim 1 wherein said exhaust valve is a diaphragm valve which is closed by positive pressure of the engine of the metering chamber and opened by the force of a spring.

3. The diaphragm carburetor according to claim 1 wherein said exhaust valve is a check valve which is opened by pressure of fuel vapor in the metering chamber.

4. The diaphragm carburetor according to claim 1 wherein said exhaust valve is a hand-operated tapered cock.

5. The diaphragm carburetor according to claim 1 wherein said exhaust valve is a needle valve which is closed by intake negative pressure while being opened by atmospheric pressure.

* * * * *